US006860249B2

(12) United States Patent
Carpenter

(10) Patent No.: US 6,860,249 B2
(45) Date of Patent: Mar. 1, 2005

(54) INTAKE MANIFOLD WITH MOUNTING FLANGE AND INSERT FOR REINFORCING THE FLANGE

(75) Inventor: Timothy Neil Carpenter, Galesburg, MI (US)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 126 days.

(21) Appl. No.: 10/231,190

(22) Filed: Aug. 30, 2002

(65) Prior Publication Data

US 2003/0041833 A1 Mar. 6, 2003

Related U.S. Application Data

(60) Provisional application No. 60/315,954, filed on Aug. 31, 2001.

(51) Int. Cl.[7] ..... F02M 35/10
(52) U.S. Cl. ..... 123/184.61
(58) Field of Search ..... 123/184.21–184.61; 312/348.2

(56) References Cited

U.S. PATENT DOCUMENTS 4,462,344 A 7/1984 Ura
4,862,610 A * 9/1989 Lawless ..... 38/102.91
5,076,723 A * 12/1991 Berger ..... 403/12
5,653,200 A 8/1997 Hafner et al.
5,690,405 A * 11/1997 Huber ..... 312/348.2
5,983,508 A * 11/1999 Sundstrom ..... 30/386
5,992,369 A 11/1999 Mehne
6,192,849 B1 * 2/2001 Powell ..... 123/184.34
6,286,471 B1 * 9/2001 Powell ..... 123/184.24
6,662,772 B1 * 12/2003 Murphy ..... 123/184.21
6,691,767 B2 * 2/2004 Southwick et al. ..... 165/67

FOREIGN PATENT DOCUMENTS

DE 19613279 1/1997
JP 10078019 3/1998

* cited by examiner

*Primary Examiner*—Marguerite McMahon
(74) *Attorney, Agent, or Firm*—Crowell & Moring LLP

(57) ABSTRACT

An insert for reinforcing a flange component and an intake manifold for an internal combustion engine in which such an insert is used. The insert (14*a*) is open toward a longitudinal side (17) of the cylinder head flange (13), so that a mounting bolt does not have to be pushed through the passageways (16) formed by the insert, but can be inserted from the side. This offers advantages during mounting, since the intake manifold can be pushed onto pre-mounted bolts, which are subsequently tightened to fix the intake manifold. The intake manifold and the described insert are therefore particularly suitable for cost-effective mounting in tight spaces.

6 Claims, 2 Drawing Sheets

INTAKE MANIFOLD WITH MOUNTING FLANGE AND INSERT FOR REINFORCING THE FLANGE

BACKGROUND OF THE INVENTION

The invention relates to an intake manifold for an internal combustion engine with a mounting flange reinforced by an insert, to an insert for reinforcing flange components, and to a mounting method for an intake manifold.

Intake manifolds with reinforcement components in the flange area are known. DE 196 13 279 A1, for instance, discloses an intake manifold with intake pipes 10, 11, 12, 13 (cf. FIG. 1 of this document) that end in a cylinder head flange. This cylinder head flange has passages 14, 15, 18, 19, which are provided for mounting the cylinder head flange with the aid of mounting bolts. Since the intake manifold is made of plastic, the passages, according to FIG. 2 of this document, are provided with reinforcement sleeves 22, which take up the stress of the mounting bolts and thereby limit the deformation of the cylinder head flange.

Increasingly tight space conditions within the engine compartment, however, require considerable flexibility in modern intake manifolds with respect to the mounting procedure of the intake manifold to the engine block. The manifold design described above, however, satisfies these mounting requirements only to a limited extent. The intake manifold with the cylinder head flange must be transferred to the installation site and subsequently fixed by the mounting bolts. For this purpose, a bolting clearance must be taken into account. In other words, there must be sufficient room to position the tool for the mounting bolts. In addition, after positioning the cylinder head flange, the bolts must be inserted into the corresponding passages, which requires a relatively long axial movement of the mounting bolts

SUMMARY OF THE INVENTION

Thus, it is an object of the invention to provide an improved intake manifold with a reinforced mounting flange.

It is also an object of the invention to provide improved inserts for reinforcing the flange component of an intake manifold, which will aid mounting even in tight spaces.

A further object of the invention is to provide a new method for mounting an intake manifold.

These and other objects are achieved in accordance with one aspect of the invention by providing an intake manifold for an internal combustion engine, with the manifold having a mounting flange provided with at least one fastener receiving passage, and with an insert made of a stiffer material than the flange disposed in the passage, wherein the passage and the insert are open toward an edge of the flange such that a fastener can be inserted into the passage from the side.

In accordance with another aspect of the invention, the objects are achieved by providing an insert for reinforcing a flange component with a passageway for a fastener, wherein the passageway is open toward the edge such that a fastener can be inserted into the passageway from the side.

In yet another aspect, the objects are achieved by providing a method for mounting an intake manifold to an installation site on an internal combustion engine, the manifold having a mounting flange provided with at least one fastener receiving passage, and with an insert made of a stiffer material than the flange disposed in said passage; the passage and the insert being open toward the edge of the flange such that a fastener can be inserted into the passage from the side intake manifold; the method comprising laterally pushing the intake manifold flange with the at least one open insert onto a fastener, and subsequently fixing the manifold in place with the fastener.

The intake manifold according to the invention comprises the structures for guiding the engine intake air in a generally known manner. According to the typical construction, an intake manifold comprises an intake, which ends in a plenum, from which the intake pipes branch off toward the cylinder head flange. The cylinder head flange, which has suitable seats for fasteners, is used to mount the intake manifold to the cylinder head of the engine.

The intake manifold can be made, for example, of synthetic resin material or of a light metal. These materials contribute to reducing the weight of the vehicle. However, such materials must be reinforced in the area of the seats for the fastener in order to permit reliable mounting. The seats are therefore reinforced with inserts, which, for instance, surround the passages. Such reinforcing devices consist of bushings, which may be made of steel or brass depending on the required rigidity of the reinforcement.

The invention is characterized in that both the passage, which is formed by the mounting flange, especially a cylinder head flange, and the insert itself, which is introduced into the passage of the flange component, are open toward the edge of the flange. In other words, the passage is not a closed sleeve with only an upper and a lower opening for inserting the fastener, particularly a mounting bolt. Instead, the upper and lower opening are connected by a type of slot or passageway, as it were, in the sidewall of the sleeve. This slot results in a configuration that is open toward the edge of the flange, so that the fastener can be inserted into the passage from the side. This eliminates an axial movement of the fastener through the openings of the passage. Rather, the fastener can be introduced directly from the side through the slot into the insert. Movements at an angle from above are of course also possible, so that a cross between insertion from the top and insertion from the side is produced. This makes it possible optimally to adapt the intake manifold and the inserts according to the invention to the space conditions within the engine compartment with respect to the assembly movement.

The insert for reinforcing the flange component according to the invention can of course also be used elsewhere. A prerequisite is that the passageway of the insert, which is provided to receive the fastener, has the above-described lateral slot-type opening. The insert must therefore have an open design toward the edge and must be mounted at the installation site in such a way that the opening toward the edge is continued in the flange component. This makes it possible, after installation of the insert, to introduce the fastener from the side of the flange.

This results in a mounting procedure, which is suitable for the intake manifold according to the invention. The fastener can be pre-installed loosely at the installation site. As used herein the phrase "loosely installed" is intended to indicate that the fastener is not fully tightened. In the case of fastening bolts for a cylinder head flange, the bolts can thus be partially screwed into the cylinder head. The intake manifold can then be positioned on the pre-installed bolts by means of the open inserts. Thereafter, the bolts need only to be tightened, so that the mounting tools have to execute only a minor assembly movement of the bolts or the fastener. This eliminates particularly the long axial assembly path of the fastener, which do not have to be inserted through the holes formed by the prior art inserts.

According to a further embodiment of the invention, the insert is substantially U-shaped as viewed in cross section. The open side of the U is then oriented toward the edge of the flange to permit insertion from the side.

A further embodiment of the invention provides for the use of a plurality of inserts according to the invention, which are arranged along the longitudinal side of the cylinder head flange. This especially facilitates the above-described mounting procedure, since the mounting bolts can be pre-installed in a row, and the intake manifold with the cylinder head flange can be readily placed onto this row of fasteners before the fasteners are finally tightened.

According to a further advantageous variant, the inserts may be provided with means for producing a form-fit connection to the flange component. In other words, the design of the insert is such that it prevents the mounted insert from slipping sideways out of the flange, which is open toward the edge. Advantageously, this is accomplished particularly by a circumferential bulge or bead, which results in the form-fit connection. With respect to the opening direction of the seat for the insert within the flange component, the means for producing a form-fit connection must therefore form a kind of undercut, which serves as a retaining means to prevent the insert from slipping out.

Of course, the described measure can be supported by other standard measures used for mounting components. For instance, the sleeves can be glued in or inserted hot. In the case of hot insertion, the material of the flange component is plastically deformed to produce a form-fit connection. Furthermore, a frictional connection can be produced by overdimensioning the insert to secure the insert against slipping out of its seat.

These and other features of preferred embodiments of the invention, in addition to being set forth in the claims, are also disclosed in the specification and/or the drawings, and the individual features each may be implemented in embodiments of the invention either alone or in the form of subcombinations of two or more features and can be applied to other fields of use and may constitute advantageous, separately protectable constructions for which protection is also claimed.

BRIEF DESCRIPTION OF THE DRAWING

The invention will be described in further detail hereinafter with reference to illustrative preferred embodiments shown in the accompanying drawings, in which.

DETAILED DESCRIPTION OF PREFERRED EMBODIMENTS

Figure 1:
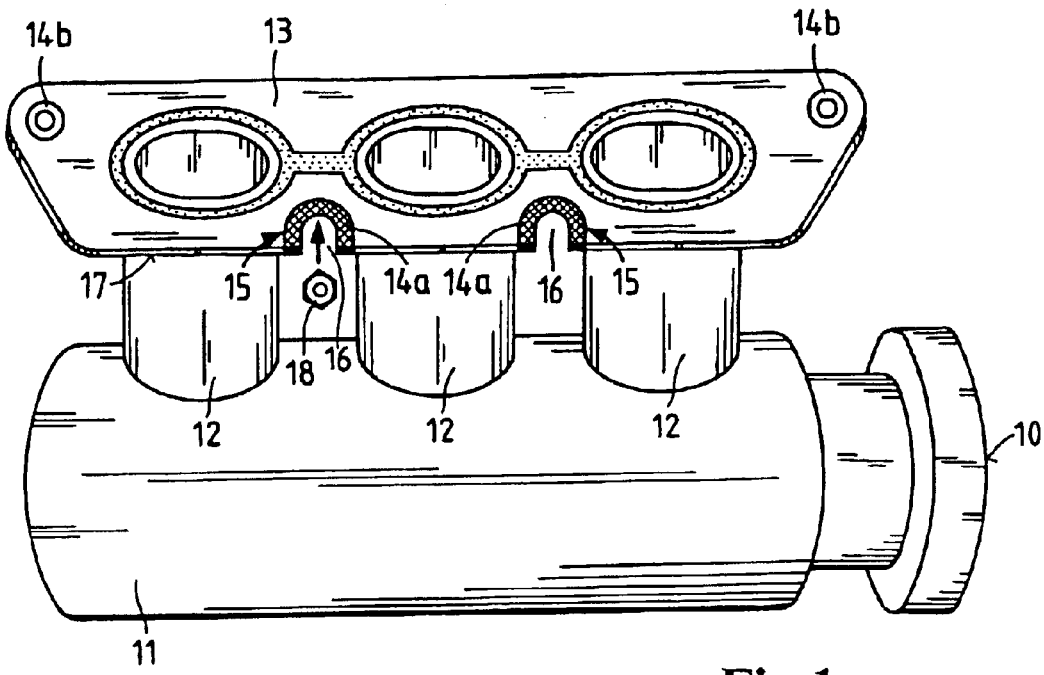
FIG. 1 is a view of an intake manifold according to the invention at a right angle to the base of the cylinder head flange.

The intake manifold according to FIG. 1 comprises an intake 10 for the combustion air, which opens in a known manner into a plenum 11. From the plenum, intake pipes 12 branch off toward a cylinder head flange 13. In the latter, various steel inserts 14*a, b* are mounted and thus reinforce the cylinder head flange 13, which is made of synthetic resin material.

The inserts 14*b* are designed according to the prior art. Of particular interest, therefore, are the inserts 14*a,* which are configured as follows. Inserts 14*a* are mounted inside passages 15, which are formed by the cylinder head flange 13. The inserts themselves have passageways 16, which are formed on a longitudinal side 17 of the cylinder head flange 13, i.e., said passageways are open toward the edge of the cylinder head flange. This allows insertion of a hexagon head cap screw 18, which is schematically depicted below the flange 13, into passage 15 from the side. This mounting procedure is made possible by a U-shaped configuration of the associated insert 14*a.* One could also speak of the insert 14*a* having a horseshoe configuration.

Figure 2:
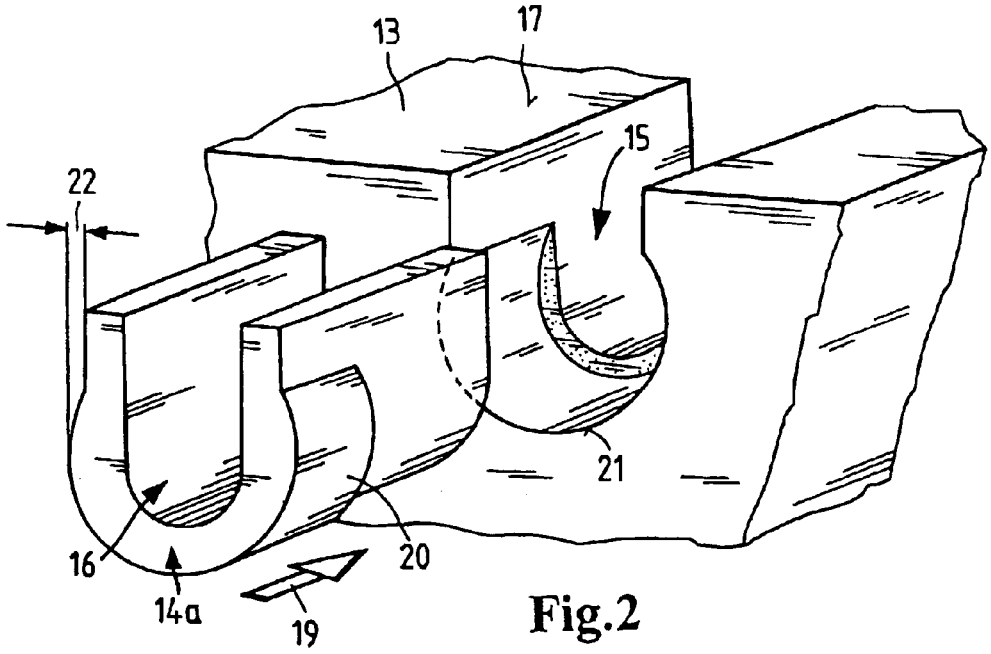
FIG. 2 is a perspective view of an insert according to the invention on an associated flange component.

FIG. 2 shows a flange component 13, which could for instance be a detail of the longitudinal side 17 of the intake manifold according to FIG. 1. Insert 14*a* is depicted in a perspective view just before being mounted in the direction of arrow 19. Clearly visible is the U-shaped cross section as well as an annular bulge or bead 20, which surrounds the curved portion of the U profile in the form of a ring and after installation of the insert mates with a shoulder 21 formed in passage 15. After installation of insert 14*a,* the insert is thus secured against slipping out in the direction of longitudinal side 17 by an undercut 22 creating a form-fit connection.

Figure 3:
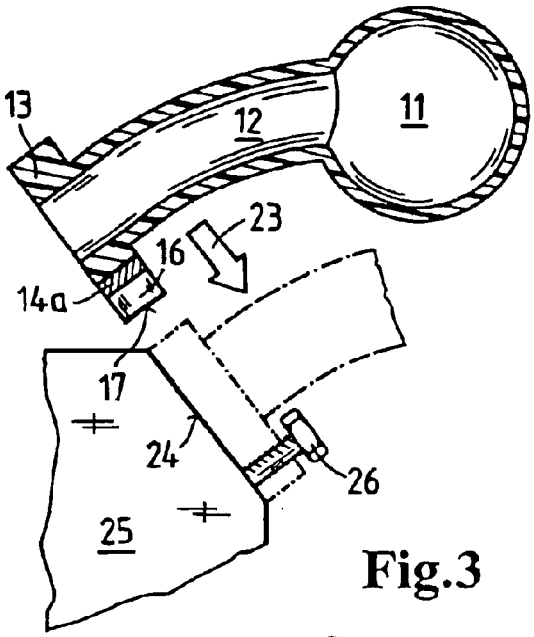
FIG. 3 schematically illustrates the mounting of an intake manifold according to the invention to the cylinder head of an internal combustion engine.

The intake manifold according to FIG. 3 is depicted in cross section. One of the intake pipes 12, plenum 11, and cylinder head flange 13 are shown in cross section. Insert 14*a* is also shown in cross section so that passageway 16 is visible.

The intake manifold is moved in the direction indicated by arrow 23 and brought into the position indicated in broken lines on a cylinder head 24 of an internal combustion engine 25. Passageway 16 is thereby brought into contact with a loosely inserted mounting bolt 26 and provisionally fixed. Final fixation is effected by tightening the mounting bolt 26. The depicted assembly direction 23 is thus made possible by passageway 16 of insert 14*a,* which is open toward the longitudinal side 17 of flange 13.

Figure 4A:
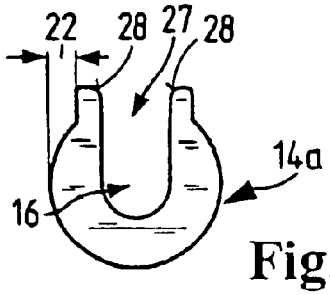
FIGS. 4*a–c* show different variants of inserts.

FIG. 4*a* is a top view of insert 14*a* of FIG. 2. In addition, the open end 27 of the insert is constructed with rounded edges 28, which facilitates insertion of the fastener into passageway 16. The undercut 22 is also clearly visible in this view.

Figure 4B:
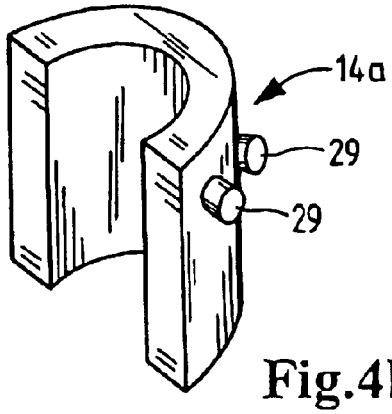

FIG. 4*b* shows another version of insert 14*a*. It has small lugs 29, which are integrally cast onto the outside surface of the insert. This insert is therefore particularly suitable for fastening within a flange component made of plastic, where the final fixation is provided by lugs 29.

Figure 4C:
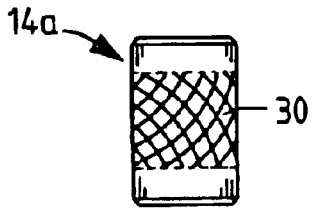

Insert 14*a* is shown in a side view in FIG. 4*c*. It is provided with circumferential ribbing 30 around the outer surface of the insert, which makes the insert particularly suitable for use as a hot insert.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. An intake manifold for an internal combustion engine, said manifold having a mounting flange provided with at least one fastener receiving passage, and an insert made of a stiffer material than the flange disposed in said passage, wherein said passage and said insert are open toward an edge of the flange such that a fastener can be inserted into the passage from the side.

2. An intake manifold according to claim 1, wherein the insert has a substantially U-shaped cross section with the open side of the U being oriented toward the edge of the flange.

3. An intake manifold according to claim 1, wherein said mounting flange is a cylinder head flange.

4. An intake manifold according to claim 3, wherein a plurality of intake pipes for combustion air are integrated the cylinder head flange, and wherein a plurality of said inserts are arranged along one longitudinal side of the cylinder head flange.

5. A method for mounting an intake manifold to an installation site on an internal combustion engine, said manifold having a mounting flange provided with at least one fastener receiving passage, and with an insert made of a stiffer material than the flange disposed in said passage; said passage and said insert being open toward the edge of the flange such that a fastener can be inserted into the passage from the side intake manifold, said method comprising laterally pushing the intake manifold flange with the at least one open insert onto a fastener, and subsequently fixing the manifold in place with the fastener.

6. A method according to claim 5, wherein said fastener is a bolt loosely pre-mounted at the installation site, and the subsequent fixing is effected by tightening the bolt after the manifold with the insert has been pushed laterally thereon.

* * * * *